US009840804B2

(12) United States Patent
Schenkl

(10) Patent No.: US 9,840,804 B2
(45) Date of Patent: Dec. 12, 2017

(54) WASHING MACHINE

(71) Applicant: emz-Hanauer GmbH & Co. KGaA, Nabburg (DE)

(72) Inventor: Johann Schenkl, Nabburg (DE)

(73) Assignee: emz-Hanauer GmbH & Co. KGaA (DE)

( * ) Notice: Subject to any disclaimer, the term of this patent is extended or adjusted under 35 U.S.C. 154(b) by 207 days.

(21) Appl. No.: 14/663,506

(22) Filed: Mar. 20, 2015

(65) Prior Publication Data

US 2015/0267339 A1 Sep. 24, 2015

(30) Foreign Application Priority Data

Mar. 21, 2014 (DE) ..... 10 2014 205 368

(51) Int. Cl.

| | |
|---|---|
| ***D06F 39/00*** | (2006.01) |
| ***D06F 33/02*** | (2006.01) |
| ***D06F 37/38*** | (2006.01) |
| *D06F 35/00* | (2006.01) |

(52) U.S. Cl.

CPC ..... *D06F 39/003* (2013.01); *D06F 33/02* (2013.01); *D06F 37/38* (2013.01); *D06F 35/005* (2013.01); *D06F 2202/02* (2013.01); *D06F 2202/065* (2013.01); *D06F 2202/085* (2013.01); *D06F 2202/10* (2013.01); *D06F 2216/00* (2013.01); *D06F 2220/00* (2013.01); *D06F 2222/00* (2013.01)

(58) Field of Classification Search

CPC ..... D06F 33/02; D06F 37/38; D06F 39/003; D06F 2202/02; D06F 2201/10; D06F 2202/065; D06F 2202/085; D06F 2216/00; D06F 2220/00; D06F 2222/00

See application file for complete search history.

(56) References Cited

U.S. PATENT DOCUMENTS

| | | | | |
|---|---|---|---|---|
| 4,742,698 | A | 5/1988 | Torita | |
| 5,946,946 | A * | 9/1999 | Sharp | D06F 37/20 188/129 |

(Continued)

FOREIGN PATENT DOCUMENTS

| | | | |
|---|---|---|---|
| DE | 19943245 | A1 | 4/2000 |
| DE | 102005028253 | B3 | 11/2006 |

(Continued)

*Primary Examiner* — Joseph L Perrin
(74) *Attorney, Agent, or Firm* — Robert R. Deleault, Esq.; Mesmer & Deleault, PLLC

(57) ABSTRACT

A washing machine includes a machine housing, a tub that is suspended on a plurality of support arms in the machine housing, and a washing drum that is rotatably mounted in the tub, at least one of the support arms being equipped with a force sensor, which generates a force measurement signal that is representative of the force acting upon the respective support arm. Moreover, the washing machine is equipped with a level sensor, which generates a level signal that is representative of the water level in the washing drum, and an electronic control unit that processes the force measurement signal and the level signal, and which is configured to control the sequence of a washing program of the washing machine in dependence on the force measurement signal and the level signal.

17 Claims, 6 Drawing Sheets

(56) References Cited

U.S. PATENT DOCUMENTS

| | | | | |
|---|---|---|---|---|
| 6,065,170 | A * | 5/2000 | Jang | D06F 37/203 68/12.04 |
| 6,460,381 | B1 * | 10/2002 | Yoshida | D06F 37/203 68/12.04 |
| 6,983,657 | B1 * | 1/2006 | Kakutani | D06F 37/24 73/779 |
| 2011/0113567 | A1 * | 5/2011 | Lee | D06F 39/003 8/137 |
| 2012/0060299 | A1 * | 3/2012 | Kim | D06F 21/08 8/137 |
| 2012/0279263 | A1 * | 11/2012 | Eglmeier | D06F 37/04 68/12.23 |

FOREIGN PATENT DOCUMENTS

| | | | |
|---|---|---|---|
| DE | 102008008338 | A1 | 8/2009 |
| DE | 102009002622 | A1 | 10/2010 |
| DE | 102010013386 | A1 | 10/2011 |

* cited by examiner

WASHING MACHINE

BACKGROUND OF THE INVENTION

1. Field of the Invention

The present invention relates generally to a washing machine. Particularly, the present invention relates to a washing machine that includes a machine housing, a tub that is suspended on a plurality of support arms, in the machine housing, and a washing drum that is rotatably mounted in the tub.

2. Description of the Prior Art

In the operation of a washing machine, the quality of the result of a washing process depends on a multiplicity of parameters such as, for example, the quantity, and therefore the weight, of the laundry in the washing drum, the nature of the laundry, the quantity of water let into the washing drum during the washing process, etc. Similarly, the quality of the result of a spinning operation performed to conclude a washing process is influenced significantly by the parameters listed above.

It is known from DE 10 2010 013 386 A1 to equip a washing machine with a sensor by which the position of a tub, suspended in a positionally variable manner in a housing by means of four springs, can be sensed, relative to the housing. The sensor may be realized as a pressure sensor or force sensor. The signals output by the sensor, which are characteristic of the position of the tub in the housing, can be used to control an actively controllable damper by means of which the tub is mounted in the housing.

DE 10 2005 028 253 B3 discloses a measuring device capable of sensing movements of a washing machine drum that are caused by imbalances, for example as a result of the washing machine drum being unevenly loaded with laundry. The signals output by the measuring device are used to control the rotational speed of the washing machine drum.

Finally, modern washing machines are usually equipped with a level sensor for sensing the water level in the washing machine drum. A level sensor suitable for use in a washing machine is described, for example, in DE 10 2008 008 338 A1.

SUMMARY OF THE INVENTION

The invention is based on the object of specifying a washing machine that renders possible optimized control of the washing process, and thus optimization of the quality of the result of the washing process.

The present invention achieves these and other objectives by providing a washing machine having the features of claim 1.

In one embodiment of the present invention, a washing machine according to the invention comprises a machine housing and a tub that is suspended on a plurality of support arms, in the machine housing. For example, the washing machine may comprise four support arms for mounting the tub in a suspended manner. A washing drum is rotatably mounted in the tub. The washing machine is preferably a so-called top-loader washing machine, i.e. a washing machine whose washing drum can be loaded with laundry through an access opening provided in the region of a top side of the washing machine. At least one of the support arms for suspending the tub in the machine housing is equipped with a force sensor, which generates a force measurement signal that is representative of the force acting upon the respective support arm. In particular, the force measurement signal generated by the force sensor is representative of a tensile force exerted upon the support arm by the washing drum.

Moreover, the washing machine is provided with a level sensor, which generates a level signal that is representative of the water level in the washing drum. For example, a level sensor such as that described in DE 10 2008 008 338 A1 may be used in the washing machine. Moreover, a level sensor realized as a multistage level switch may also be used. Finally, the washing machine comprises an electronic control unit that processes the force measurement signal and the level signal. The electronic control unit is configured to control the sequence of a washing program of the washing machine in dependence on the force measurement signal and the level signal.

A multiplicity of parameters, which depend on the type and quantity of the laundry put into the washing drum of the washing machine when the washing machine is operated, can be inferred from the force measurement signal generated by the force sensor and from the level signal generated by the level sensor. In particular, it is possible to infer parameters that are not possible on the basis of merely one sensor signal, i.e. for example only one force measurement signal or only one level signal. The control and, if necessary, adjustment of the sequence of the washing program on the basis of the parameters that are determined on the basis of the sensor signals and that are dependent on the type and quantity of the laundry present in the washing drum of the washing machine make it possible to realize savings in time and energy, for example by shortening the washing program. Moreover, the quality of the results of the washing process can be optimized, while at the same time the laundry is treated with care. Finally, the signals generated by the force sensor and the level sensor can be used to control the sequence of the washing program of the washing machine so as to avoid overstressing and/or damaging the washing machine. As a result, the expected service life of the washing machine can be increased. Moreover, noise generated during operation of the washing machine can be minimized.

The electronic control unit may be configured to induce a predefined movement of the washing drum, at the start of the sensing and evaluation of the signals generated by the force sensor and the level sensor. For example, the electronic control unit may induce a revolution of the washing drum, for example to minimize unwanted frictional effects that could impair the measuring accuracy.

In a preferred embodiment of the washing machine, each support arm has a first end that acts in combination with a bearing element of the machine housing, and a second end that acts in combination with a bearing element of the tub. The bearing element of the machine housing may extend, for example, from an inner surface of the machine housing in the direction of the tub accommodated in the machine housing, and have a through-opening, through which the support arm can be routed. The bearing element of the tub, by contrast, may extend from an outer surface of the tub in the direction of the machine housing. The bearing element of the tub is preferably likewise provided with a through-opening, through which the support arm can be routed.

Preferably, the support arm is spring-mounted in the region of at least one end. In particular, the support arm may be mounted, in the region of its first and/or its second end, by means of a spring whose ends are supported on the bearing element of the machine housing and on a complementary bearing element of the support arm, or on the bearing element of the tub and on a complementary bearing element of the support arm. In a preferred embodiment of the washing machine, each support arm is spring-mounted solely in the region of its second end.

The force sensor may be disposed in the region of the first end of the support arm, between the bearing element of the machine housing and the complementary bearing element of the support arm, or in the region of the second end of the support arm, between the bearing element of the tub and the complementary bearing element of the support arm. In the case of such an arrangement, the force acting upon the support arm is transmitted to the force sensor by the combined action of the bearing element of the machine housing with the complementary bearing element of the support arm, or of the bearing element of the tub with the complementary bearing element of the support arm, thereby enabling the force acting upon the support arm to be sensed easily in a reliable and precise manner. If the force sensor is disposed in the region of a spring-mounted end of the support arm, the force sensor may be positioned between the bearing element of the machine housing, or of the tub, and the spring, or between the complementary bearing element of the support arm and the spring.

Preferably, at least two support arms of the washing machine are equipped with a force sensor. The force measurement signals generated by the force sensors may be processed further, independently of each other, by the electronic control unit, for example in order to draw inferences concerning the distribution of the force upon the support arms. As an alternative to this, however, it is also conceivable to form mean values from force measurement signals that are generated by a plurality of force sensors. In particular, if mean values are to be formed from the force measurement signals generated by two force sensors, preferably two of four support arms are equipped with force sensors, the two support arms equipped with a force sensor preferably being disposed adjacently to each other. As an alternative to this, it is clearly also conceivable to provide more than two, or all, support arms with a force sensor.

The force sensor preferably comprises at least one triple combination of a light-emitting element, a light-receiving element and a light-reflecting surface. Preferably, one of the three components of the triple combination is mounted, by means of a spring element, so as to be movable relative to the other two components. The force measurement signal is then based on the light received by the light-receiving element and reflected by the light-reflecting surface, the intensity of which light varies in dependence on the position of the one component of the triple combination relative to the other two components. For example, a force sensor described in DE 10 2010 013 386 A1 may be used in the washing machine.

The force sensor may additionally comprise a housing, in which an opening, extending through the housing, may be realized. The support arm may be routed through the opening realized in the housing of the force sensor. The force acting upon the support arm is then transmitted centrally on to the force sensor, this having a positive effect upon the measurement accuracy of the force sensor.

In a preferred embodiment of the washing machine, the electronic control unit is configured to evaluate the force measurement signal and/or the level signal during at least one of the operating phases: loading the washing drum with laundry, soaking the laundry by inlet of water into the washing drum, washing the laundry in reversing operation, pumping water out of the washing drum, removing water from the laundry by spinning, and unloading the laundry from the washing drum. The electronic control unit can then control the sequence of the washing program of the washing machine in dependence on the evaluation result, and the sensor signals determined during an operating phase can be used not just to control the sequence of the washing program during this operating phase. Rather, sensor signals and evaluation results from an operating phase can also be used to control the sequence of the washing program in another operating phase or also in the case of a subsequent washing process.

The electronic control unit may be configured to determine a loading variable that is representative of the laundry loading quantity of the washing drum, on the basis of at least one force measurement signal. For example, the control unit may compare the value of a force measurement signal that is generated by the force sensor after loading of the washing drum with laundry with a stored force measurement signal value and, in particular, subtract between these two values, in order to determine the loading variable that is representative of the laundry loading quantity of the washing drum. The stored force measurement signal value may be a value that has been factory-stored in a memory of the electronic control unit, or a value that has been determined in a previous washing process and that is representative of a force that acts upon the support arm provided with the force sensor, when the washing drum is in the non-loaded state.

The electronic control unit may also be configured, however, to determine the loading variable, that is representative of the laundry loading quantity of the washing drum, on the basis of a subtraction between two force measurement signals measured at different instants. For example, a first force measurement signal value may be sensed before the washing drum is loaded with laundry, and a second force measurement signal value sensed after the washing drum is loaded with laundry, and the difference between these two force measurement signal values then determined. Determination of the loading variable immediately before starting of the washing operation has the advantage that the loading variable represents the laundry loading quantity of the washing drum in a particularly precise manner, and without, for example, disturbance factors that are dependent on wear. Preferably, the instants for sensing of the force measurement signal values for determining the loading quantity that is representative of the laundry loading quantity of the washing drum are before the start of the inlet of water into the washing drum, in order to avoid falsification of the signals by water fed into the washing drum.

The electronic control unit may additionally be configured to determine a first absorption variable, that is representative of the absorption behavior of the laundry in the washing drum, on the basis of a time interval between the start of the inlet of water into the washing drum and a reaction of the level sensor, a force measurement signal value measured at an instant at the start of the time interval, and a force measurement signal value measured at an instant at the end of the time interval. Consequently, for the purpose of determining the first absorption variable, use is made of the fact that the infeed of water into the washing drum results directly in a change in the force measurement signal generated by the force sensor, since the water causes the weight of the washing drum to be increased by the tensile force consequently acting upon the support arm equipped with the force sensor. In contrast to this, the level sensor reacts with a delay to the inlet of water into the washing drum, since at the start of the water inlet operation the water fed into the washing drum is absorbed by the laundry in the washing drum. The more laundry there is accommodated in the washing drum, and the more absorbent this laundry is, the longer is the time interval from the start of the inlet of water into the washing drum to the occurrence of a reaction of the level sensor. Since the time interval is delimited by the start of the inlet of water into the washing drum and an instant at which a (first) reaction of the level sensor occurs, the first absorption variable represents a variable that is representative of the absorption behavior of the laundry in the washing drum when in the dry state.

Preferably, the electronic control unit is configured to determine the first absorption variable on the basis of a subtraction between the force measurement signal values measured at the start and at the end of the time interval. In other words, the electronic control unit uses the difference between force measurement signal value measured at the start of the time interval, i.e. at the start of the inlet of water into the washing drum, and the force measurement signal value that is measured following expiry of the time interval, i.e. when the level signal generated by the level sensor changes, as a measure of the quantity of the water absorbed by the laundry, and consequently to determine the first absorption variable that is representative of the absorption behavior of the laundry in the washing drum.

In particular, if the level sensor used in the washing machine is one that measures the water level in the washing drum on the basis of sensing a pressure exerted upon an air column by a water column, the problem may arise that the level sensor reacts with a time delay to the infeed of water into the washing drum, even if the washing drum has not been loaded with laundry, i.e. the water supplied to the washing drum is not absorbed, but results immediately in a rise in the water level in the washing drum. The electronic control unit may therefore be configured to determine the first absorption variable with a reference reaction delay of the level sensor having been taken into account. The reference reaction delay of the level sensor may be a defined value that has been factory-stored in a memory of the electronic control unit and that corresponds to the reaction delay of the level sensor when water is fed into a non-loaded washing drum.

In particular, the electronic control unit may determine the quantity of water fed into the washing drum during the reaction delay of the level sensor, for example by subtraction between force measurement signal values measured at the start and at the end of the reaction delay of the level sensor and, for the purpose of determining the first absorption quantity, subtract this from the quantity of water calculated by subtraction between the force measurement signal values measured at the start and at the end of the time interval. Taking account of the reaction delay of the level sensor thus prevents a quantity of water that is fed into the washing drum during the reaction delay of the level sensor from being incorrectly included in the determination of the first absorption variable, i.e. prevents the incorrect assumption that the water quantity fed into the washing drum during the reaction delay of the level sensor is absorbed by the laundry in the washing drum.

Moreover, the electronic control unit may be configured to determine a second absorption variable, that is representative of the absorption behavior of the laundry in the washing drum, on the basis of a comparison between a gradient of a time-dependent characteristic of the force measurement signal during the inlet of water into the washing drum and a gradient of a time-dependent characteristic of the level signal during the inlet of water into the washing drum. The gradient of the time-dependent characteristic of the force measurement signal during the inlet of water into the washing drum is a measure of the increase in the weight of the washing drum that is caused by the infeed of water into the washing drum and the resultant increase in the tensile force acting upon the support arm equipped with the force sensor, and is dependent, for example, on the flow rate of the water directed into the washing drum. By contrast, the gradient of the time-dependent characteristic of the level signal during the inlet of water into the washing drum is a direct measure of the increase in the water level in the washing drum during the inlet of water.

If there is no laundry present in the washing drum during the inlet of water into the washing drum, the gradient of the time-dependent characteristic of the force measurement signal corresponds to the gradient of the time-dependent characteristic of the level signal, at least following expiry of the reaction delay of the level sensor. However, if the washing drum has been filled with laundry and some of the water fed into the washing drum is absorbed by the laundry accommodated in the washing drum, the gradient of the time-dependent characteristic of the level signal is reduced, while the gradient of the time-dependent characteristic of the force measurement signal remains unaffected. It is thereby possible to infer, from a comparison of the gradients of the time-dependent characteristics of the level signal and force measurement signal, how much water is absorbed by the laundry in the washing drum during the inlet of water into the washing drum, and how the absorption behavior of the laundry varies as the infeed of water into the washing drum increases. Unlike the first absorption variable, which is representative of the absorption behavior of the laundry in the washing drum when in the dry state, the second absorption variable represents the absorption behavior of the laundry in the washing drum when in the wet state, or the development of the absorption behavior of the laundry as soaking increases.

The electronic control unit may additionally be configured to determine a third absorption variable, that is representative of the absorption behavior of the laundry in the washing drum, on the basis of a gradient of an envelope curve of the time-dependent characteristic of the level signal during the reversing operation of the washing machine. In the reversing operation of the washing machine, the time characteristic of the level signal shows a series of swings, which represent the fluctuations of the measured water level in the washing drum that result from the movements of the washing drum during the reversing operation of the washing machine, with the quantity of water in the washing drum remaining constant. A portion of the envelope curve that connects the maxima and/or the minima of the swings of the time characteristic of the level signal, and/or a curve defined by the mean values between these values, may be used to determine the third absorption variable.

Laundry accommodated in the washing drum of the washing machine also still absorbs water during the reversing operation of the washing machine, the quantity of water absorbed by the laundry during the reversing operation of the washing machine clearly depending, again, on the quantity and type of the laundry. During the reversing operation of the washing machine, the absorption of water by the laundry results in a falling envelope curve of the time-dependent characteristic of the level signal, such that the (negative) gradient of the envelope curve can be used as a measure of the absorption behavior of the laundry in the washing drum when in the fully soaked state.

Moreover, the electronic control unit is preferably configured to determine a wetness variable, that is representative of the wetness of the laundry in the washing drum before the start of the spinning operation, on the basis of a subtraction between a force measurement signal value measured after the loading of the washing drum with laundry, but before the start of the inlet of water into the washing drum, and a force measurement signal value measured after completion of a water pumping-off operation, but before the start of a spinning operation. Typically, the water pumping-off operation is complete when the level sensor emits a level signal that corresponds to a level signal emitted by the level sensor before the start of the inlet of water into the washing drum, i.e. the level signal emitted by the level sensor indicates that there is no longer any "free" water in the washing drum. On the basis of the comparison of the force measurement signal values measured after the loading of the washing drum with laundry, but before the start of the inlet of water into the washing drum, and after completion of the water pumping-off operation, but before the start of the spinning operation, the electronic control unit can therefore determine the quantity of water that has still been absorbed by the laundry after completion of the water pumping-off operation, and from this can determine the wetness variable that is representative of the wetness of the laundry in the washing drum before the start of the spinning operation.

The electronic control unit may additionally be configured to determine a moisture removal variable, that is representative of the moisture removal behavior of the laundry in the washing drum, on the basis of a gradient of an envelope curve of the time-dependent characteristic of the force measurement signal during a spinning operation of the washing machine. During the spinning operation of the washing machine, the time characteristic of the force measurement signal shows a series of swings, which represent the fluctuations of the measured force acting upon the support arm that result from the movements and oscillations of the washing drum during the spinning operation of the washing machine. A portion of the envelope curve that connects the maxima and/or the minima of the swings of the time characteristic of the level signal, and/or a curve defined by the mean values between these values, may be used to determine the moisture removal variable. If the laundry accommodated in the washing drum of the washing machine releases water during the spinning operation and this water is removed from the washing drum, this results in a falling envelope curve of the time-dependent characteristic of the force measurement signal, such that the (negative) gradient of the envelope curve can be used as a measure of the moisture removal behavior of the laundry during the spinning operation. It is understood that the moisture removal behavior of the laundry is also dependent on the quantity and type of the laundry.

In a preferred embodiment of the washing machine, the electronic control unit is additionally configured to determine a moisture variable, that is representative of the residual moisture of the laundry in the washing drum after completion of the spinning operation, on the basis of a subtraction between a force measurement signal value measured after the loading of the washing drum with laundry, but before the start of the inlet of water into the washing drum, and a force measurement signal value measured after completion of a spinning operation. On the basis of the comparison of the force measurement signal values measured after the loading of the washing drum with laundry, but before the start of the inlet of water into the washing drum, and after completion of the spinning operation, the electronic control unit can determine the quantity of water that has still been absorbed by the laundry after completion of the spinning operation, and from this can determine the moisture variable that is representative of the residual moisture of the laundry in the washing drum after completion of the spinning operation.

In a manner similar to the spinning operation of the washing machine, the time characteristic of the force measurement signal also shows a series of swings during the loading of the washing drum with laundry. These swings represent the fluctuations of the measured force acting upon the support arm that result from the movements and oscillations of the washing drum that are caused by the insertion of the laundry in the washing drum and, the greater the force that is exerted upon the laundry, and consequently upon the washing drum, by a user of the washing machine in order to press the laundry into the washing drum, the greater are these swings. The electronic control unit may therefore additionally be configured to determine a pressing force variable, that is representative of a pressing force with which the laundry is pressed in the washing drum by an operator of the washing machine, on the basis of an amplitude of a force measurement signal value variation in a time-dependent characteristic of the force measurement signal during the loading of the washing drum with laundry.

Moreover, the time characteristic of the force measurement signal also shows swings during the reversing operation of the washing machine, which swings represent the fluctuations of the measured force acting upon the support arm that result from the movements and oscillations of the washing drum during the reversing operation of the washing machine. The swings in the time characteristic of the force measurement signal during the reversing operation of the washing machine are caused partially by water sloshing back and forth in the washing drum, and partially by movements of the laundry accommodated in the washing drum. For example, water waves formed because of resonances may result in unwanted mechanical stresses and cause noise. The electronic control unit is therefore preferably additionally configured to determine a first displacement variable, that is representative of a displacement of the washing drum that is caused by water present in the washing drum, on the basis of an amplitude of a force measurement signal value variation in a time-dependent characteristic of the force measurement signal during the reversing operation of the washing machine.

In particular, the electronic control unit may be configured to determine the first displacement variable on the basis of a comparison, of the amplitude of the force measurement signal value variation in the time-dependent characteristic of the force measurement signal during the reversing operation of the washing machine, with a reference amplitude. The reference amplitude may be a defined amplitude value, or an amplitude value measured during a previous washing process, which has been stored in a memory of the electronic control unit. As an alternative to this, an average amplitude of the force measurement signal value variation in the time-dependent characteristic of the force measurement signal may also be used as a reference amplitude, in order to identify large swings in the time characteristic of the force measurement signal. For example, a large swing in the time characteristic of the force measurement signal can be attributed by the electronic control unit to a water wave sloshing back and forth in the washing drum, if the amplitude of the swing exceeds the reference amplitude by a predefined value.

As already mentioned, the time characteristic of the force measurement signal during the spinning operation of the washing machine shows a series of swings, which represent the fluctuations of the force acting upon the support arm that result from the movements and oscillations of the washing drum during the spinning operation of the washing machine. Excessive swings may occur as a result of the acceleration of the washing drum at the start of the spinning operation. The electronic control unit is therefore preferably additionally configured to determine a second displacement variable, that is representative of a displacement of the washing drum that is caused by an acceleration of the washing drum at the start of the spinning operation, on the basis of an amplitude of a force measurement signal value variation in a time-dependent characteristic of the force measurement signal during a spinning operation of the washing machine.

In particular, the electronic control unit may be configured to determine the second displacement variable on the basis of a comparison, of the amplitude of the force measurement signal value variation in the time-dependent characteristic of the force measurement signal during the spinning operation of the washing machine, with a reference amplitude. The reference amplitude may again be a defined amplitude value, or an amplitude value measured during a previous washing process, which has been stored in a memory of the electronic control unit. As an alternative to this, again, an average amplitude of the force measurement signal value variation in the time-dependent characteristic of the force measurement signal may also be used as a reference amplitude, in order to identify large swings in the time characteristic of the force measurement signal. For example, a large swing in the time characteristic of the force measurement signal can be attributed by the electronic control unit to the acceleration of the washing drum at the start of the spinning operation, if the amplitude of the swing exceeds the reference amplitude by a predefined value.

Moreover, the electronic control unit may be configured to determine an energy input variable, that is representative of a mechanical energy input into laundry present in the washing drum, on the basis of an amplitude of a force measurement signal value variation in a time-dependent characteristic of the force measurement signal and of a shape of the time-dependent characteristic of the force measurement signal during the reversing operation and/or the spinning operation of the washing machine. The energy input into the laundry present in the washing drum determines how vigorously the laundry is tumbled during the reversing operation or spinning operation of the washing machine, and therefore represents a variable that influences considerably the quality of the result of the washing or spinning operation. At the same time, however, the energy input into the laundry should not be so great that the laundry becomes damaged.

The electronic control unit may also be configured to determine a rotational speed variable, that is representative of the rotational speed of the washing drum, on the basis of a period of a force measurement signal value variation in a time-dependent characteristic of the force measurement signal during the reversing operation and/or the spinning operation of the washing machine. The term "period" is understood here to mean the period of a fundamental wave, even if the fundamental wave is overlaid by harmonic waves, in the case of overlaid frequencies. Moreover, the electronic control unit may be configured to determine a rotation direction variable, that is representative of a rotation direction of the washing drum, on the basis of a shape of the time-dependent characteristic of the force measurement signal during the reversing operation and/or the spinning operation of the washing machine. The rotational speed variable and the rotation direction variable, which are determined by the electronic control unit, may be used, for example, to check the control variables rotational speed and rotation direction when the washing machine is in operation.

Finally, the electronic control unit may be configured to identify an imbalance situation on the basis of a period of a force measurement signal value variation in a time-dependent characteristic of the force measurement signal and/or of a shape of the time-dependent characteristic of the force measurement signal during the reversing operation and/or the spinning operation of the washing machine. The term "period" is again understood here to mean the period of a fundamental wave, even if the fundamental wave is overlaid by harmonic waves, in the case of overlaid frequencies. An imbalance situation may be caused, for example, by uneven loading of the washing drum with laundry.

In a preferred embodiment of the washing machine, the electronic control unit is configured to set at least one program parameter of the washing program on the basis of the loading variable, the first absorption variable, the second absorption variable, the third absorption variable, the wetness variable, the moisture removal variable, the moisture variable, the pressing force variable, the first displacement variable, the second displacement variable, the energy input variable, the rotational speed variable, the rotation direction variable and/or the identification of an imbalance situation. Program parameters of the washing program that are to be set or adjusted on the basis of the sensing of at least one of the above-mentioned variables include, for example, a quantity of washing water to be fed in, a time characteristic of the washing water infeed, i.e. a flow rate, possibly time-dependent, of the water fed into the washing drum, a movement of the washing drum, and a duration of the reversing operation and/or of the spinning operation.

A setting or adjustment of the movement of the washing drum may include a setting or adjustment of the rotational speed, rotational speed characteristic and/or rotation direction of the washing drum. Moreover, the washing drum may be induced to execute special movements, for example to execute a single revolution for the purpose of displacing the laundry present in the washing drum and distributing it more uniformly. A setting or adjustment of the movement of the washing drum may be realized by a corresponding activation of a drive motor of the washing drum.

Moreover, the electronic control unit may be configured to determine a recommended quantity of a cleaning substance to be added, and to effect the output of a recommendation indication concerning this, on the basis of the sensing of at least one of the above-mentioned variables. The recommendation indication may be output, for example, on a display of the washing machine. Finally, the electronic control unit may be configured to check the attainment of a predefined maximum loading limit of the washing drum and, in the case of the maximum loading limit being attained or exceeded, to effect the output of a warning message concerning this, on the basis of the sensing of at least one of the above-mentioned variables. The warning message may likewise be output on a display of the washing machine, or in the form of an acoustic signal.

The electronic control unit may also be configured to calculate a remaining running time of the spinning operation, on the basis of the determined moisture variable. Moreover, the electronic control unit may be configured to effect the output of information concerning this. The information concerning the remaining running time of the spinning operation may be output, for example, on a display of the washing machine. In a preferred embodiment, the electronic control unit is additionally configured to compare the determined moisture variable with a setpoint moisture variable, and to initiate a further spinning operation if the determined moisture variable is greater than the setpoint moisture variable. As a result, a constant optimum quality of the result of the spinning operation can be ensured.

BRIEF DESCRIPTION OF THE DRAWINGS

Preferred embodiments of the invention are now explained more fully on the basis of the appended schematic drawings.

DETAILED DESCRIPTION OF THE PREFERRED EMBODIMENT

Figure 1:
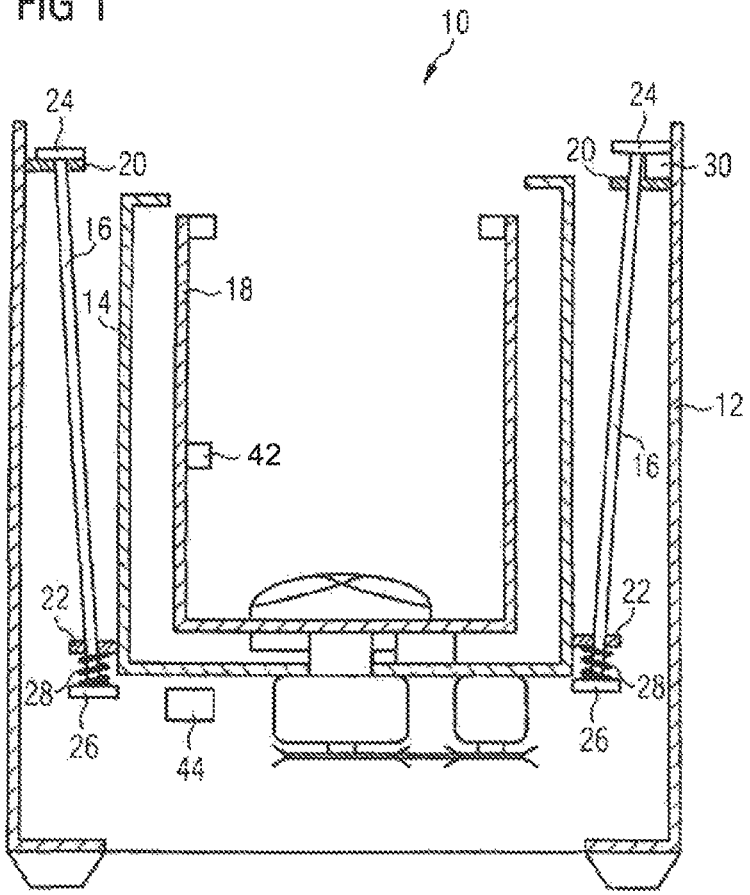
FIG. 1 shows a schematic cross-sectional representation of a top-loader washing machine.

A top-loader washing machine 10 illustrated in FIG. 1 comprises a machine housing 12 and a tub 14 that is disposed in the machine housing 12. The tub 14 is mounted in a suspended manner in the machine housing 12 by means of four support arms 16, of which only two can be seen in the sectional representation according to FIG. 1. A washing drum 18 is accommodated in a rotatable manner in the tub 14. Provided on the machine housing 12 there is a bearing element 20, which extends from an inner surface of the machine housing 12 in the direction of the tub 14 accommodated in the machine housing 12, and which has a through-opening, through which a first end of the support arm 16 is routed. Similarly, the tub 14 is also provided with a bearing element 22, which extends from an outer surface of the tub 14 in the direction of the machine housing 12, and which likewise has a through-opening, through which a second end of the support arm 16 is routed.

In the region of its first end, each support arm 16 is provided with a bearing element 24 that is complementary to the bearing element 20 of the machine housing 12. In the region of its second end, on the other hand, each support arm 16 has a bearing element 26 that is complementary to the bearing element 22 of the tub 14. In the region of their second ends, the support arms 16 are each spring-mounted by means of a spring 28, the ends of which are supported on the bearing element 22 of the tub 14 and on the complementary bearing element 26 of the support arm. In the case of the support arm 16 shown on the left side in FIG. 1, the bearing element 20 of the machine housing 12 acts directly in combination with the complementary bearing element 24 of the support arm 16, in the region of the first end of the support arm 16, i.e. the bearing element 24 of the support arm 16 lies on the bearing element 20 of the machine housing 12, in order to fasten the support arm 16 to the bearing element 20 of the machine housing 12 in a suspended manner.

Figure 2:
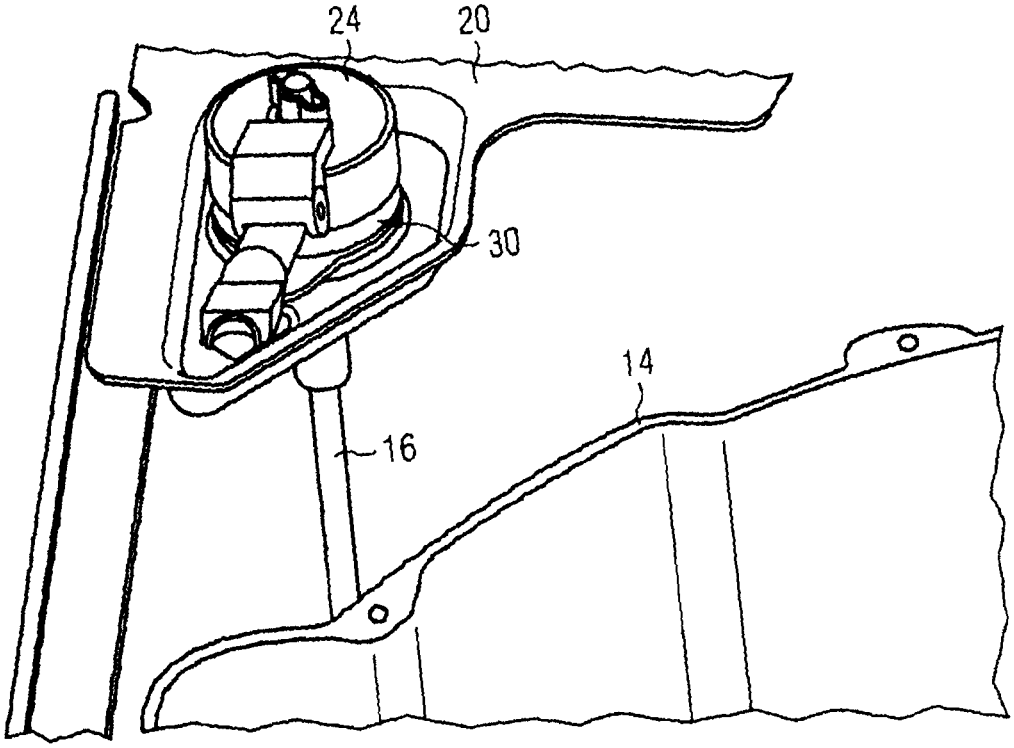
FIG. 2 shows a detail representation of a support arm of the washing machine according to FIG. 1, provided with a force sensor in the region of a first end, when mounted in the washing machine.

By contrast, the support arm 16 shown on the right side in FIG. 1 is equipped with a force sensor 30, which generates a force measurement signal that is representative of the force acting upon the respective support arm 16. In particular, the force measurement signal generated by the force sensor 30 is representative of a tensile force exerted upon the support arm 16 by the washing drum 18, via the tub 14. The force sensor 30 is disposed between the bearing element 20 of the machine housing 12 and the complementary bearing element 24 of the support arm 16, in the region of the first end of the support arm 16. As shown most clearly by the representation according to FIG. 2, in the case of such an arrangement the tensile force acting upon the support arm 16 is transmitted to the force sensor 30 by the combined action of the bearing element 20 of the machine housing 12 with the complementary bearing element 24 of the support arm 16.

Figure 3:
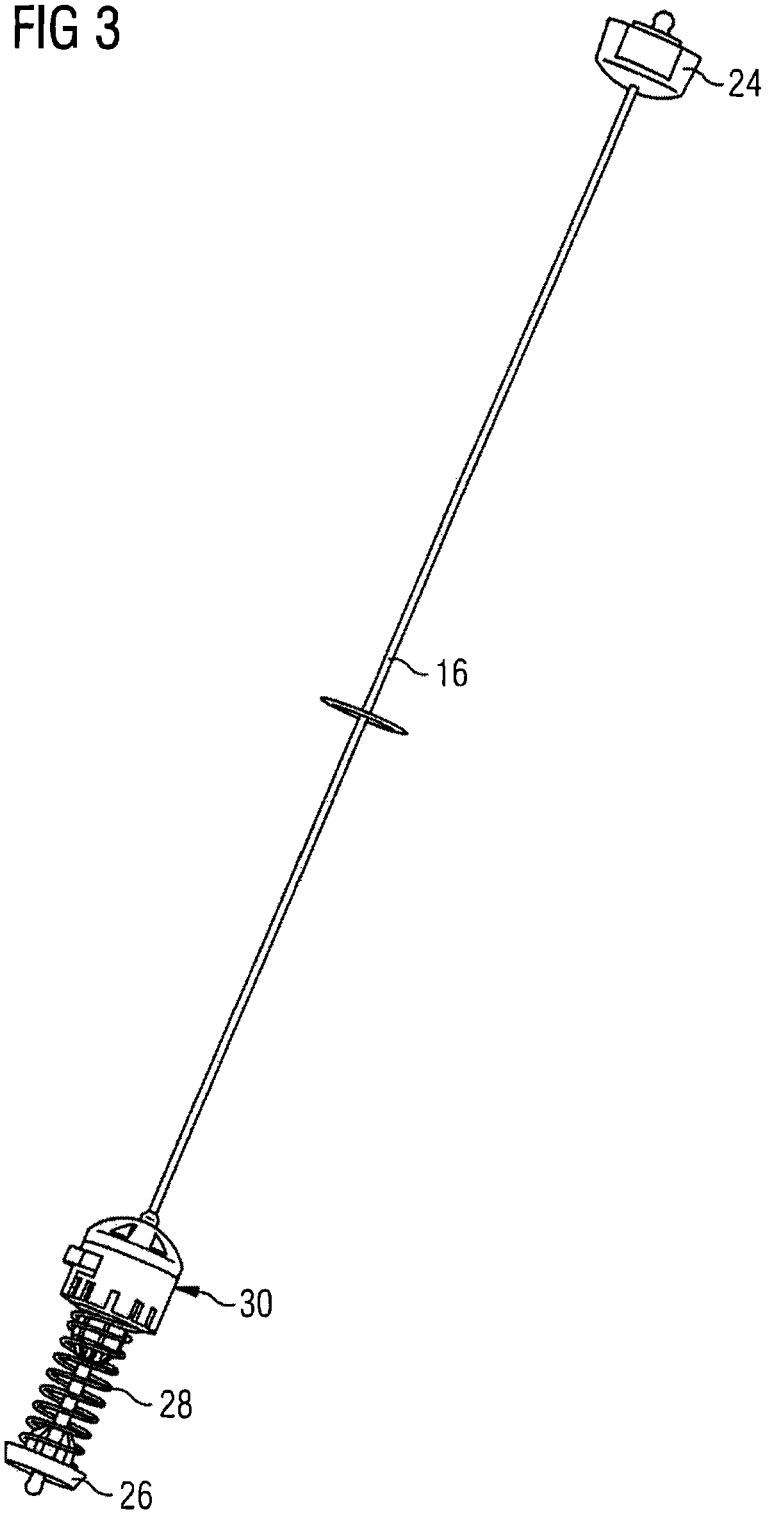
FIG. 3 shows a support arm provided with a force sensor in the region of a second end that is suitable for use in the washing machine according to FIG. 1.

As shown by FIG. 3, it is also conceivable, however, for the support arm 16 to be provided, in the region of its second end, with a force sensor 30 that, when the support arm 16 is mounted in the washing machine 10, is disposed between the bearing element 22 of the tub 14 and the spring 28 that is supported on the complementary bearing element 24 of the support arm 16, or on the force sensor 30. Moreover, a plurality of support arms 16 of the washing machine 10, in particular two mutually adjacent support arms 16, may also be provided with a force sensor 30.

Figure 4:
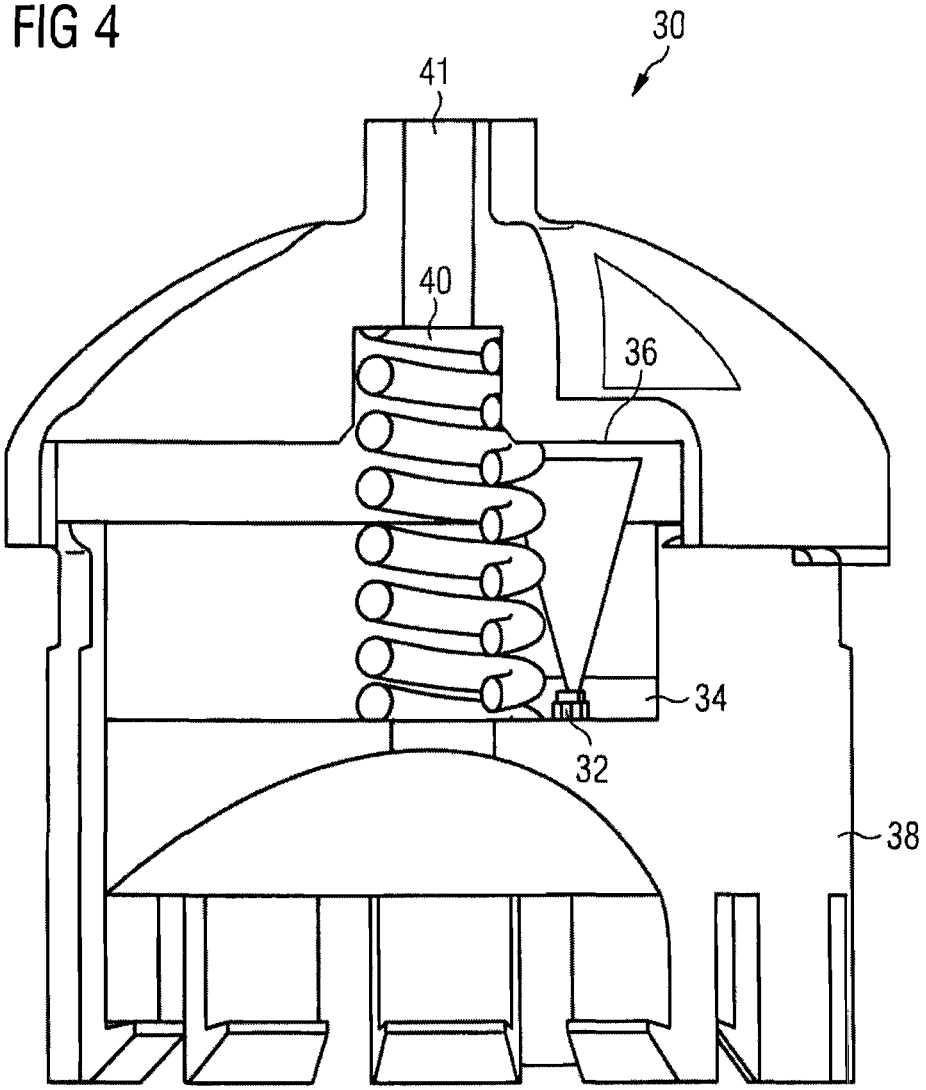
FIG. 4 shows a detail representation of the force sensor integrated into the support arm.

A detail representation of the force sensor 30 integrated into the support arm 16 is shown in FIG. 4. The force sensor 30 comprises a light-emitting element 32, a light-receiving element 34 and a light-reflecting surface 36. The light-emitting element 32 and the light-receiving element 34 are disposed in a fixed manner in a housing 38 of the force sensor 30. The light-reflecting surface 36, on the other hand, is mounted, by means of a spring element 40, so as to be movable relative to the housing 38 of the force sensor 30, and therefore relative to the light-emitting element 32 and the light-receiving element 34. The intensity of the light emitted by the light-emitting element 32 and reflected by the light-reflecting surface 36 varies in dependence on the variable distance between the light-reflecting surface 36 and the housing 38 that carries light-emitting element 32 and the light-receiving element 34.

Consequently, the force measurement signal generated by the force sensor 30 is then based on the light received by the light-receiving element 34 and reflected by the light-reflecting surface, the intensity of which light varies in dependence on the position of the light-reflecting surface 36 in relation to the housing 38, and therefore relative to the light-emitting element 32 and the light-receiving element 34.

Realized in the housing 38 of the force sensor 30 is an opening 41, which extends through the housing 38. The support arm 16 can be introduced into this opening 41 and routed through the housing 38 of the force sensor 30, see FIG. 3. The force acting upon the support arm 16 is then transmitted centrally on to the force sensor 30.

The washing machine 10 is additionally provided with a level sensor 42, which generates a level signal that is representative of the water level in the washing drum 18. The level sensor 42 measures the water level in the washing drum 18 on the basis of the sensing of a pressure exerted upon an air column by a water column. Finally, the washing machine 10 comprises an electronic control unit 44, which processes the force measurement signal and the level signal.

The electronic control unit 44 is configured to control the sequence of a washing program of the washing machine 10 in dependence on the force measurement signal and the level signal.

When the washing machine 10 is operating, a washing operation can be divided into the operating phases: loading the washing drum 18 with laundry, soaking the laundry by inlet of water into the washing drum 18, washing the laundry in reversing operation, pumping water out of the washing drum 18, removing water from the laundry by spinning, and unloading the laundry from the washing drum 18. In the preferred embodiment of a washing machine 10 shown in FIG. 1, the electronic control unit 44 is configured to evaluate the force measurement signal and/or the level signal from the current and/or a previous washing operation, during these operating phases, and to control the sequence of the washing program of the washing machine in dependence on the evaluation result.

Figure 5:
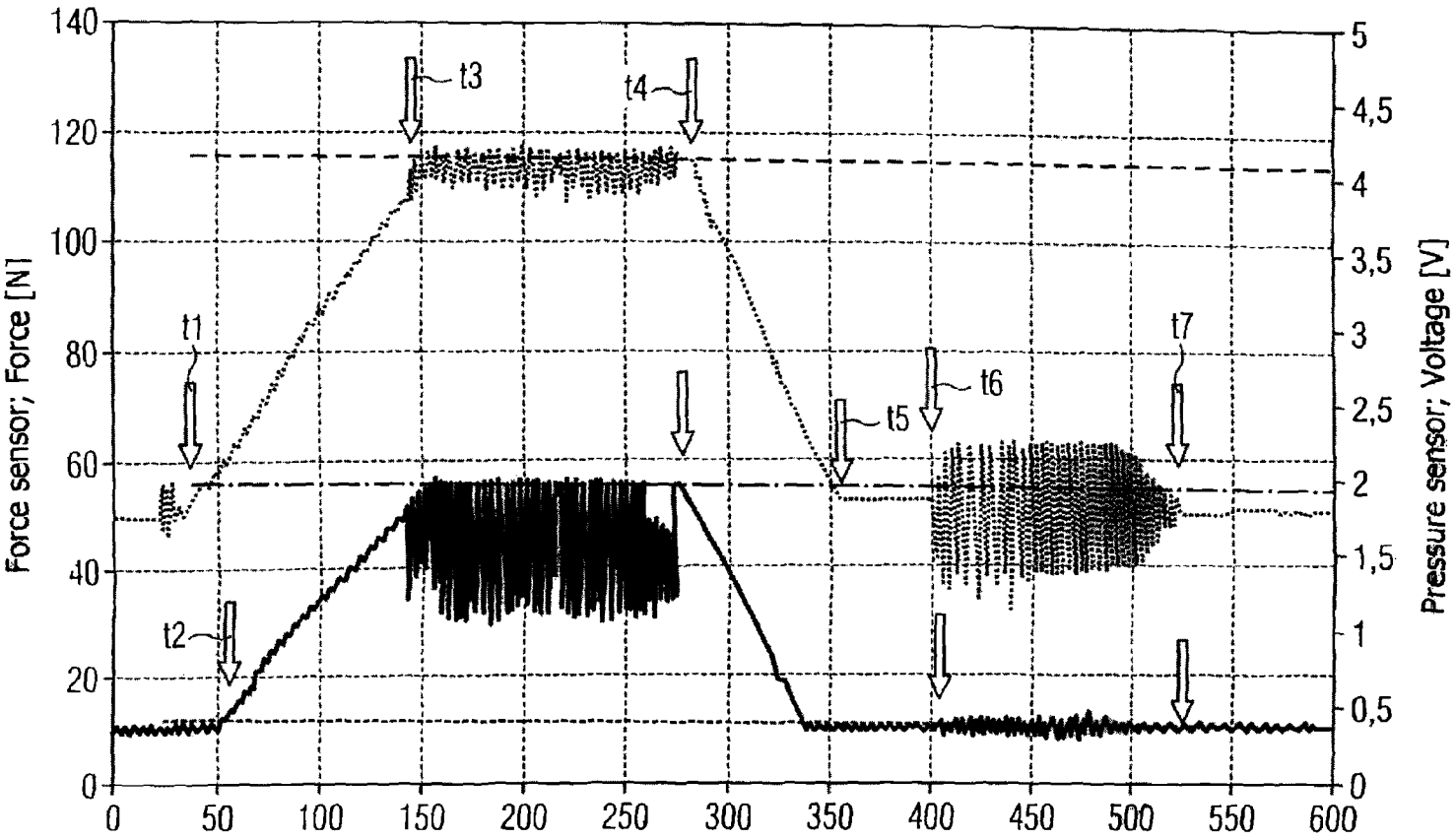
FIG. 5 shows a time-dependent characteristic of a force measurement signal generated by the force sensor, and a time-dependent characteristic of a level signal generated by a level sensor, during a washing process with a non-loaded washing drum.

FIG. 5 shows a time-dependent characteristic of the force measurement signal generated by the force sensor 30 (upper curve), and a time-dependent characteristic of the level signal generated by the level sensor 42 (lower curve) during a washing process with a non-loaded washing drum 18, i.e. in the case of the washing operation shown in FIG. 5, the operating phase of loading the washing drum 18 with laundry is absent. The infeed of water into the washing drum 18 begins at an instant t1. The force measurement signal generated by the force sensor 30 thereupon rises continuously without a time delay, since the infeed of water into the washing drum 18 causes the weight of the washing drum 18, and consequently the tensile force acting upon the support arm 16, to increase continuously. The gradient of the time-dependent characteristic of the force measurement signal generated by the force sensor 30 during the water inlet phase is determined by the flow rate of the water let into the washing drum 18.

In contrast thereto, the level sensor 42 is designed to react with a time delay to the infeed of water into the washing drum 18, i.e. the level signal generated by the level sensor 42 does not start to rise already at the instant t1, but only at the instant t2. Moreover, the shape of the washing drum 18 can also effect a time delay of the reaction of the level sensor 42. After the instant t2, the level signal also rises continuously, the gradient of the time-dependent characteristic of the level signal during the water inlet phase corresponding substantially to the gradient of the time-dependent characteristic of the force measurement signal generated by the force sensor 30, and likewise being determined by the flow rate of the water let into the washing drum 18.

At an instant t3, the infeed of water in to the washing drum 18 ends and the reversing operation commences. In the reversing operation of the washing machine 10, the time characteristic of the force measurement signal and the time characteristic of the level signal show a series of swings, which represent the fluctuations of the measured force and of the measured water level in the washing drum 18 that result from the movements of the washing drum 18 during the reversing operation of the washing machine 10, with the quantity of water in the washing drum 18 remaining constant. At the instant t4, the reversing operation is ended, and a water pumping-off phase begins, during which the water is pumped out of the washing drum 18, and which ends in the instant t5. Typically, the water pumping-off phase has ended when the level sensor 42 emits a level signal that corresponds to a level signal emitted by the level sensor 42 before the start of the inlet of water into the washing drum 18. If the washing drum 18 has not been loaded with laundry, at the end of the pumping-off operation, at the instant t5, the force measurement signal generated by the force sensor 30 also corresponds to a force measurement signal emitted by the force sensor 30 before the start of the inlet of water into the washing drum 18, i.e. following completion of the pumping-off operation, there is no longer any water present in the washing drum 18 that increases the weight of the washing drum 18.

Finally, at the instant t6, the spinning phase begins, which lasts until the instant t7. During the spinning operation of the washing machine 10, the time characteristic of the force measurement signal and the time characteristic of the level signal again show a series of swings, which represent the fluctuations of the measured force and of the measured water level in the washing drum 18 that result from the movements of the washing drum 18.

Figure 6:
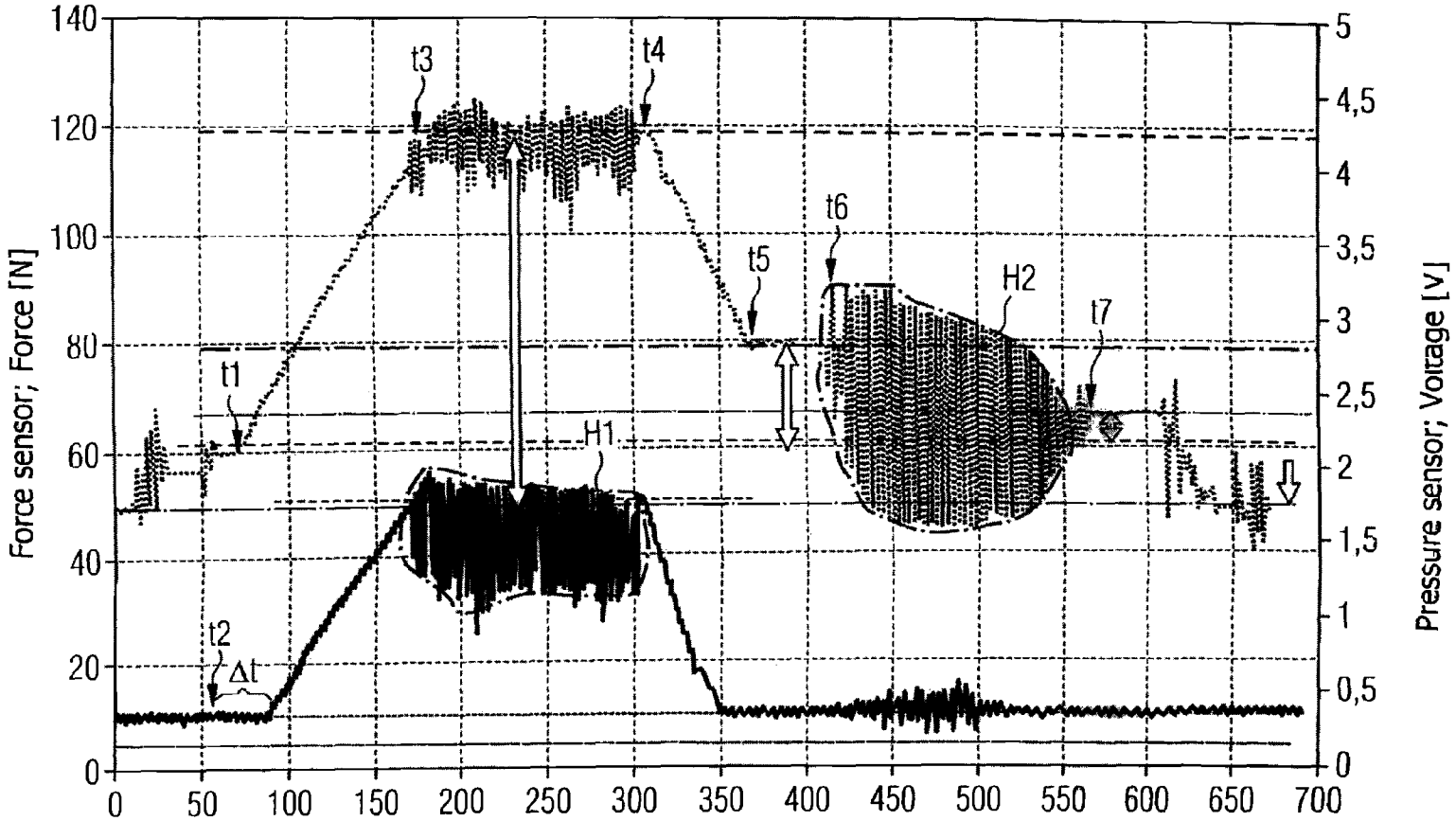
FIG. 6 shows a time-dependent characteristic of a force measurement signal generated by the force sensor, and a time-dependent characteristic of a level signal generated by a level sensor, during a washing process with a loaded washing drum.

FIG. 6 shows a time-dependent characteristic of the force measurement signal generated by the force sensor 30 (upper curve), and a time-dependent characteristic of the level signal generated by the level sensor 42 (lower curve) during a washing process with a loaded washing drum 18. Unlike the curves in FIG. 5, the time characteristic of the force measurement signal shows a series of swings before the instant t1. These swings represent the fluctuations of the measured force acting upon the support arm 16 that result from movements and oscillations of the washing drum 18 that are caused by the insertion of the laundry in the washing drum 18 and, the greater the force that is exerted upon the laundry, and consequently upon the washing drum 18, by a user of the washing machine 10 in order to press the laundry into the washing drum, the greater are these swings. The electronic control unit 44 therefore determines a pressing force variable, that is representative of a pressing force with which the laundry is pressed in the washing drum 18 by an operator of the washing machine, on the basis of an amplitude of the force measurement signal value variation in the time-dependent characteristic of the force measurement signal during the loading of the washing drum with laundry.

Moreover, the electronic control unit 44 determines a loading variable that is representative of the laundry loading quantity of the washing drum 18. For this purpose, the control unit may sense the value of a force measurement signal generated by the force sensor 30 after the loading of the washing drum 18 with laundry, but before the infeed of water into the washing drum 18, and compare it with a stored force measurement signal value. The stored force measurement signal value may be a value that has been factory-stored in a memory of the electronic control unit 44, or a value that has been determined in a previous washing process and that is representative of a force that acts upon the support arm provided with the force sensor 30, when the washing drum 18 is in the non-loaded state. However, the loading variable that is representative of the laundry loading quantity of the washing drum 18 can be determined in a particularly precise manner, without disturbance factors, if the electronic control unit 44 determines the loading variable that is representative of the laundry loading quantity of the washing drum 18 on the basis of a subtraction between two force measurement signal values measured at different instants. For example, a first force measurement signal value may be sensed before the loading of the washing drum 18 with laundry, and a second force measurement signal value sensed after the loading of the washing drum 18 with laundry, and the difference between these two force measurement signal values then determined.

As evident from a comparison of the time characteristics of the level signals generated by the level sensor 42 in FIGS.

5 and 6, the infeed of water into the washing drum 18 results immediately in a change in the force measurement signal generated by the force sensor 30, irrespective of the loading state of the washing drum 18, since the infed water causes the weight of the washing drum 18 to be increased by the tensile force consequently acting upon the support arm 16 equipped with the force sensor. In contrast to this, in the case of a loaded washing drum 18 the level sensor 42 reacts with a time delay, beyond its design reaction delay, to the inlet of water into the washing drum 18, since at the start of the water inlet operation the water fed into the washing drum 18 is absorbed by the laundry in the washing drum 18.

The electronic control unit 44 can therefore determine a first absorption variable, that is representative of the absorption behavior of the laundry in the washing drum 18, when in the dry state, on the basis of a time interval Δt between the start of the inlet of water into the washing drum 18 and a reaction of the level sensor 42, a force measurement signal value measured at an instant at the start of the time interval Δt, and a force measurement signal value measured at an instant at the end of the time interval Δt. The more laundry that is accommodated in the washing drum 18, and the more absorbent this laundry, the longer is the time interval Δt from the start of the inlet of water into the washing drum 18 to the occurrence of a reaction of the level sensor 42. In particular, the electronic control unit 44 determines the first absorption variable on the basis of a subtraction between the force measurement signal values measured at the start and at the end of the time interval Δt. The electronic control unit 44 thus uses the difference between the force measurement signal value measured at the start of the inlet of water into the washing drum 18 and the force measurement signal value that is measured following expiry of the time interval Δt, as a measure of the quantity of the water absorbed by the laundry, and consequently to determine the first absorption variable that is representative of the absorption behavior of the laundry in the washing drum.

If a particularly precise determination of the first absorption variable is required, the electronic control unit 44 determines the first absorption variable with a reference reaction delay of the level sensor 42 having been taken into account, the reference reaction delay used being the reaction delay of the level sensor 42 that has been stored in a memory of the electronic control unit 44, in the case of the infeed of water into a non-loaded washing drum. The electronic control unit 44 determines the quantity of water fed into the washing drum 18 during the reaction delay of the level sensor 42 by subtraction between force measurement signal values measured at the start and at the end of the reaction delay of the level sensor 42, and subtracts this quantity of water from the quantity of water calculated by subtraction between the force measurement signal values measured at the start and at the end of the time interval Δt. This prevents a quantity of water that is fed into the washing drum 18 during the reaction delay of the level sensor 42 from being incorrectly included in the determination of the first absorption variable, i.e. prevents the incorrect assumption that the water quantity fed into the washing drum 18 during the reaction delay of the level sensor 42 is absorbed by the laundry in the washing drum 18.

As in the case of the non-loaded washing drum 18, the gradient of the time-dependent characteristic of the force measurement signal during the inlet of water into the loaded washing drum 18 is a measure of the increase in the weight of the washing drum 18 that is caused by the infeed of water into the washing drum 18 and the resultant increase tensile force acting upon the support arm 16 equipped with the force sensor 30. By contrast, the gradient of the time-dependent characteristic of the level signal during the inlet of water into the washing drum 18 is a direct measure of the increase in the water level in the washing drum 18 during the inlet of water. If there is no laundry present in the washing drum 18 during the inlet of water into the washing drum 18, the gradient of the time-dependent characteristic of the force measurement signal corresponds to the gradient of the time-dependent characteristic of the level signal, at least following expiry of the reaction delay of the level sensor 42. However, if the washing drum 18 has been filled with laundry and some of the water fed into the washing drum 18 is absorbed by the laundry accommodated in the washing drum 18, the gradient of the time-dependent characteristic of the level signal is reduced, while the gradient of the time-dependent characteristic of the force measurement signal remains unaffected.

The electronic control unit 44 can therefore determine a second absorption variable, that is representative of the absorption behavior of the laundry in the washing drum 18, on the basis of a comparison between the gradient of the time-dependent characteristic of the force measurement signal during the inlet of water into the washing drum 18 and the gradient of the time-dependent characteristic of the level signal during the inlet of water into the washing drum 18. The second absorption variable represents the absorption behavior of the laundry in the washing drum 18 when in the wet state, or the development of the absorption behavior of the laundry as soaking increases.

Laundry accommodated in the washing drum 18 of the washing machine 10 also still absorbs water during the reversing operation of the washing machine 10. During the reversing operation of the washing machine 10, the absorption of water by the laundry results in a falling envelope curve H1 of the time-dependent characteristic of the level signal. The electronic control unit 44 can therefore determine a third absorption variable, that is representative of the absorption behavior of the laundry in the washing drum 18, and that represents a measure of the absorption behavior of the laundry in the washing drum 18 when in the fully soaked state, on the basis of a gradient of the envelope curve H1.

As is evident from a comparison of the time-dependent characteristics of the force measurement signals generated by the force sensor 30, shown in FIGS. 5 and 6, at the end of the water pumping-off operation, at the instant t5, the value of the force measurement signal when the washing machine 10 is operated with a loaded washing drum 18, unlike the case of operation of the washing machine 10 with a non-loaded washing drum 18, is significantly above the force measurement signal value measured after the loading of the washing drum 18 with laundry, but before the start of the inlet of water into the washing drum 18. This is caused by the fact that, when the washing machine 10 is operated with a loaded washing drum 18, the water cannot be completely pumped out of the washing drum 18, because some of it has been absorbed by the laundry accommodated in the washing drum 18. The electronic control unit 44 can therefore determine a wetness variable, that is representative of the wetness of the laundry in the washing drum 18 before the start of the spinning operation, on the basis of a subtraction between a force measurement signal value measured after the loading of the washing drum 18 with laundry, but before the start of the inlet of water into the washing drum 18, and a force measurement signal value measured after completion of a water pumping-off operation, but before the start of a spinning operation.

During the spinning operation of the washing machine 10 with a loaded washing drum 18, the time characteristic of the force measurement signal shows a series of swings, which represent the fluctuations of the measured force acting upon the support arm 16 that result from the movements and oscillations of the washing drum 18 during the spinning operation of the washing machine. If the laundry accommodated in the washing drum 18 of the washing machine releases water during the spinning operation and this water is removed from the washing drum 18, this results in a falling envelope curve H2 of the time-dependent characteristic of the force measurement signal. The electronic control unit 44 determines a moisture removal variable, that is representative of the moisture removal behavior of the laundry in the washing drum 18, on the basis of a gradient of the envelope curve H2 of the time-dependent characteristic of the force measurement signal during a spinning operation of the washing machine 10.

Also following the completion of the spinning operation, in the instant t7, the value of the force measurement signal when the washing machine 10 is operated with a loaded washing drum 18, unlike the case of operation of the washing machine 10 with a non-loaded washing drum 18, is still above the force measurement signal value measured after the loading of the washing drum 18 with laundry, but before the start of the inlet of water into the washing drum 18. This is caused by the fact that water, in the form of residual moisture, is still contained in the laundry even after completion of the spinning operation. The electronic control unit 44 is therefore able to determine a moisture variable, that is representative of the residual moisture of the laundry in the washing drum 18 after completion of the spinning operation, on the basis of a subtraction between a force measurement signal value measured after the loading of the washing drum 18 with laundry, but before the start of the inlet of water into the washing drum 18, and a force measurement signal value measured after completion of a spinning operation.

During the reversing operation of the washing machine 10, also, the time characteristic of the force measurement signal shows swings, which represent the fluctuations of the measured force acting upon the support arm 16 that result from the movements and oscillations of the washing drum 18 during the reversing operation of the washing machine. These swings are caused partially by water sloshing back and forth in the washing drum. For example, water waves formed because of resonances may result in unwanted mechanical stresses and cause noise. The electronic control unit 44 therefore determines a first displacement variable, that is representative of a displacement of the washing drum 18 that is caused by water present in the washing drum, on the basis of an amplitude of a force measurement signal value variation in a time-dependent characteristic of the force measurement signal during the reversing operation of the washing machine 10.

In particular, the electronic control unit 44 determines the first displacement variable on the basis of a comparison, of the amplitude of the force measurement signal value variation in the time-dependent characteristic of the force measurement signal during the reversing operation of the washing machine, with a reference amplitude, which may be a defined amplitude value, or an amplitude value measured during a previous washing process, which has been stored in a memory of the electronic control unit 44, or an average amplitude of the force measurement signal value variation in the time-dependent characteristic of the force measurement signal. It is of importance only that the electronic control unit 44 identifies large swings in the time characteristic of the force measurement signal and attributes them to a water wave sloshing back and forth in the washing drum 18, for example if the amplitude of the swing exceeds the reference amplitude by a predefined value.

Moreover, the electronic control unit 44 determines a second displacement variable, that is representative of a displacement of the washing drum 18 that is caused by an acceleration of the washing drum 18 at the start of the spinning operation, on the basis of an amplitude of the force measurement signal value variation in the time-dependent characteristic of the force measurement signal during a spinning operation of the washing machine 10. The electronic control unit 44 thus identifies excessive amplitudes, in particular occurring at the start of the spinning operation, as excessive amplitudes caused by the acceleration of the washing drum at the start of the spinning operation.

Again, the electronic control unit 44 can determine the second displacement variable on the basis of a comparison, of the amplitude of the force measurement signal value variation in the time-dependent characteristic of the force measurement signal during the spinning operation of the washing machine 10, with a reference amplitude. The reference amplitude may again be a defined amplitude value, or an amplitude value measured during a previous washing process, which has been stored in a memory of the electronic control unit 44. As an alternative to this, again, an average amplitude of the force measurement signal value variation in the time-dependent characteristic of the force measurement signal may also be used as a reference amplitude, in order to identify excessive swings in the time characteristic of the force measurement signal that are attributable to the acceleration of the washing drum 18 at the start of the spinning operation.

The electronic control unit 44 additionally determines an energy input variable, that is representative of a mechanical energy input into laundry present in the washing drum 18, on the basis of an amplitude of the force measurement signal value variation in the time-dependent characteristic of the force measurement signal and a shape of the time-dependent characteristic of the force measurement signal during the reversing operation and/or the spinning operation of the washing machine 10. Moreover, the electronic control unit 44 determines a rotational speed variable, that is representative of the rotational speed of the washing drum 18, on the basis of a period of the force measurement signal value variation in the time-dependent characteristic of the force measurement signal during the reversing operation and/or the spinning operation of the washing machine 10. A rotation direction variable that is representative of a rotation direction of the washing drum 18 is determined by the electronic control unit 44 on the basis of the shape of the time-dependent characteristic of the force measurement signal during the reversing operation and/or the spinning operation of the washing machine 10. Finally, the electronic control unit 44 can identify an imbalance situation on the basis of a period of the force measurement signal value variation in the time-dependent characteristic of the force measurement signal and/or of the shape of the time-dependent characteristic of the force measurement signal during the reversing operation and/or the spinning operation of the of the washing machine 10, which imbalance situation is caused, for example, by uneven loading of the washing drum 18 with laundry.

At least one program parameter of the washing program of the washing machine 10 is set or adjusted by the electronic control unit 44 on the basis of the loading variable, the first absorption variable, the second absorption variable, the third absorption variable, the wetness variable, the moisture removal variable, the moisture variable, the pressing force variable, the first displacement variable, the second displacement variable, the energy input variable, the rotational speed variable, the rotation direction variable and/or the identification of an imbalance situation. In particular, the electronic control unit 44 uses the above-mentioned parameters as measures of the quantity and the type of the laundry accommodated in the washing drum 18 of the washing machine 10, and to adjust the washing program accordingly. Program parameters of the washing program that are to be set or adjusted on the basis of the sensing of at least one of the above-mentioned variables include, for example, a quantity of washing water to be fed in, a time characteristic of the washing water infeed, i.e. a flow rate, possibly time-dependent, of the water fed into the washing drum, a movement of the washing drum 18, in particular a rotational speed, a rotation direction and/or a rotational speed characteristic, and a duration of the reversing operation and/or of the spinning operation. The rotational speed variable and the rotation direction variable, which are determined by the electronic control unit 44, may be used, for example, to check the control variables rotational speed and rotation direction when the washing machine 10 is in operation.

Moreover, the electronic control unit 44 can determine a recommended quantity of a cleaning substance to be added, and effect the output of a recommendation indication concerning this, on the basis of the sensing of at least one of the above-mentioned variables. Moreover, the electronic control unit 44 can check the attainment of a predefined maximum loading limit of the washing drum 18 and, in the case of the maximum loading limit being attained or exceeded, effect the output of a warning message concerning this, on the basis of the sensing of at least one of the above-mentioned variables.

The electronic control unit 44 can also calculate a remaining running time of the spinning operation, on the basis of the determined moisture variable. Information concerning the remaining running time of the spinning operation may be output, for example, on a display of the washing machine 10. Finally, the electronic control unit 44 can compare the determined moisture variable with a setpoint moisture variable, and initiate a further spinning operation if the determined moisture variable is greater than the setpoint moisture variable.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A washing machine comprising:

a machine housing;

a tub that is suspended on a plurality of support arms in the machine housing;

a washing drum that is rotatable in the tub, at least one of the support arms being equipped with a force sensor, which generates a force measurement signal that is representative of the force acting upon the respective support arm;

a level sensor, which generates a level signal that is representative of the water level in the washing drum; and an electronic control unit that is configured to process the force measurement signal and the level signal, to determine a first absorption variable, that depends on the quantity of the laundry and how absorbent the type of laundry in the washing drum is in a dry state, and a second absorption variable, that depends on the quantity of the laundry and on either how absorbent the type of laundry in the washing drum is in a wet state or on the development of how absorbent the type of laundry is as soaking increases, on the basis of the force measurement signal and the level signal, and which is configured to control the sequence of a washing program of the washing machine in dependence on the first absorption variable and the second absorption variable.

2. The washing machine according to claim 1 wherein each support arm has a first end that acts in combination with a bearing element of the machine housing, and a second end that acts in combination with a bearing element of the tub, and being spring-mounted in the region of at least one end, and the force sensor being disposed in the region of the first end of the support arm, between the bearing element of the machine housing and a complementary bearing element of the support arm, or in the region of the second end of the support arm, between the bearing element of the tub and a complementary bearing element of the support arm, wherein in particular at least two mutually adjacent, support arms are equipped with a force sensor.

3. The washing machine according to claim 1 wherein the force sensor comprising at least one of:

at least one triple combination of a light-emitting element, a light-receiving element and a light-reflecting surface, one of the three components of the triple combination being mounted, by means of a spring element, so as to be movable relative to the other two components, and the force measurement signal being based on the light received by the light-receiving element and reflected by the light-reflecting surface, the intensity of which light varies in dependence on the position of the one component of the triple combination relative to the other two components; and a housing, the support arm being routed through an opening realized in the housing.

4. The washing machine according to claim 1 wherein the electronic control unit is configured (a) to evaluate at least one of the force measurement signal and the level signal during at least one of the operating phases, the operating phases comprising:

loading the washing drum with laundry;

soaking the laundry by inlet of water into the washing drum;

washing the laundry in reversing operation;

pumping water out of the washing drum;

removing water from the laundry by spinning; and unloading the laundry from the washing drum; and (b) to control the sequence of the washing program of the washing machine in dependence on the evaluation result.

5. The washing machine according to claim 1 wherein the electronic control unit is configured to determine a loading variable that is representative of the laundry loading quantity of the washing drum, on the basis of at least one force measurement signal, wherein the electronic control unit in particular is configured to determine the loading variable, that is representative of the laundry loading quantity of the washing drum, on the basis of a subtraction between two force measurement signals measured at different instants, the instants being preferably before the start of the inlet of water into the washing drum.

6. The washing machine according to claim 1 wherein the electronic control unit is configured to determine the first absorption variable, that is representative of the absorption behavior of the laundry in the washing drum, on the basis of (a) a time interval between the start of the inlet of water into the washing drum and a reaction of the level sensor, (b) a force measurement signal value measured at an instant at the start of the time interval, and (c) a force measurement signal value measured at an instant at the end of the time interval.

7. The washing machine according to claim 6 wherein the electronic control unit is configured to determine the first absorption variable on the basis of a subtraction between the force measurement signal values measured at the start and at the end of the time interval, wherein the electronic control unit in particular is configured to determine the first absorption variable with a reference reaction delay of the level sensor having been taken into account.

8. The washing machine according to claim 1 wherein the electronic control unit is configured to determine the second absorption variable, that is representative of the absorption behavior of the laundry in the washing drum, on the basis of a comparison between (a) a gradient of a time-dependent characteristic of the force measurement signal during the inlet of water into the washing drum and (b) a gradient of a time-dependent characteristic of the level signal during the inlet of water into the washing drum.

9. The washing machine according to claim 1 wherein the electronic control unit is configured to determine at least one of (a) a third absorption variable, that is representative of the absorption behaviour of the laundry in the washing drum, on the basis of a gradient of an envelope curve of the time-dependent characteristic of the level signal during the reversing operation of the washing machine, (b) a wetness variable, that is representative of the wetness of the laundry in the washing drum before the start of the spinning operation, on the basis of a subtraction between a force measurement signal value measured after the loading of the washing drum with laundry, but before the start of the inlet of water into the washing drum, and a force measurement signal value measured after completion of a water pumping-off operation, but before the start of a spinning operation, (c) a moisture removal variable, that is representative of the moisture removal behavior of the laundry in the washing drum, on the basis of a gradient of an envelope curve of the time-dependent characteristic of the force measurement signal during a spinning operation of the washing machine, (d) a moisture variable, that is representative of the residual moisture of the laundry in the washing drum after completion of the spinning operation, on the basis of a subtraction between a force measurement signal value measured after the loading of the washing drum with laundry, but before the start of the inlet of water into the washing drum, and a force measurement signal value measured after completion of a spinning operation, (e) a pressing force variable, that is representative of a pressing force with which the laundry is pressed in the washing drum by an operator of the washing machine, on the basis of an amplitude of a force measurement signal value variation in a time-dependent characteristic of the force measurement signal during the loading of the washing drum with laundry, and (f) a first displacement variable, that is representative of a displacement of the washing drum that is caused by water present in the washing drum, on the basis of an amplitude of a force measurement signal value variation in a time-dependent characteristic of the force measurement signal during the reversing operation of the washing machine.

10. The washing machine according to claim 9 wherein the electronic control unit is configured to determine the first displacement variable on the basis of a comparison, of the amplitude of the force measurement signal value variation in the time-dependent characteristic of the force measurement signal during the reversing operation of the washing machine, with a reference amplitude.

11. The washing machine according to claim 1 wherein the electronic control unit is configured to determine a second displacement variable, that is representative of a displacement of the washing drum that is caused by an acceleration of the washing drum at the start of the spinning operation, on the basis of an amplitude of a force measurement signal value variation in a time-dependent characteristic of the force measurement signal during a spinning operation of the washing machine.

12. The washing machine according to claim 11 wherein the electronic control unit is configured to determine the second displacement variable on the basis of a comparison, of the amplitude of the force measurement signal value variation in the time-dependent characteristic of the force measurement signal during the spinning operation of the washing machine, with a reference amplitude.

13. The washing machine according to claim 1 wherein the electronic control unit is configured to determine at least one of (a) an energy input variable, that is representative of a mechanical energy input into laundry present in the washing drum, on the basis of an amplitude of a force measurement signal value variation in a time-dependent characteristic of the force measurement signal and of a shape of the time-dependent characteristic of the force measurement signal during at least one of the reversing operation and the spinning operation of the washing machine, (b) a rotational speed variable, that is representative of the rotational speed of the washing drum, on the basis of a period of a force measurement signal value variation in a time-dependent characteristic of the force measurement signal during at least one of the reversing operation and the spinning operation of the washing machine, and (c) a rotation direction variable, that is representative of a rotation direction of the washing drum, on the basis of a shape of the time-dependent characteristic of the force measurement signal during at least one of the reversing operation and the spinning operation of the washing machine.

14. The washing machine according to claim 1 wherein the electronic control unit is configured to identify an imbalance situation on the basis of at least one of a period of a force measurement signal value variation in a time-dependent characteristic of the force measurement signal and a shape of the time-dependent characteristic of the force measurement signal during at least one of the reversing operation and the spinning operation of the washing machine.

15. The washing machine according to claim 1 wherein the electronic control unit is configured to at least one of (a) set, on the basis of at least one of the loading variable, the first absorption variable, the second absorption variable, the third absorption variable, the wetness variable, the moisture removal variable, the moisture variable, the pressing force variable, the first displacement variable, the second displacement variable, the energy input variable, the rotational speed variable, the rotation direction variable and the identification of an imbalance situation at least one of (1) at least one program parameter of the washing program, in particular a quantity of washing water to be fed in, (2) a time characteristic of the washing water infeed, (3) a movement of the washing drum, in particular at least one of a rotational speed and a rotational speed characteristic, and (4) a duration of at least one of the reversing operation and of the spinning operation, (b) determine a recommended quantity of a cleaning substance to be added, and to effect the output of a recommendation indication concerning this, and (c) check the attainment of a predefined maximum loading limit of the washing drum and, in the case of the maximum loading limit being attained or exceeded, to effect the output of a warning message concerning the attained or exceeded maximum loading limit.

16. The washing machine according to claim 15 wherein the electronic control unit is configured to calculate a remaining running time of the spinning operation, on the basis of the determined moisture variable, and to effect an output of information concerning the remaining running time of the spinning operation.

17. The washing machine according to claim 15 wherein the electronic control unit is configured to compare the determined moisture variable with a setpoint moisture variable, and to initiate a further spinning operation if the determined moisture variable is greater than the setpoint moisture variable.

* * * * *